US010358837B2

(12) United States Patent
Khamis et al.

(10) Patent No.: US 10,358,837 B2
(45) Date of Patent: Jul. 23, 2019

(54) BEACH ENTRY FIBERGLASS POOL BODY

(71) Applicant: Thursday Pools, Fortville, IN (US)

(72) Inventors: William Khamis, Fortville, IN (US); Edward Vondell, Fishers, IN (US)

(73) Assignee: Thursday Pools, Fortville, IN (US)

( * ) Notice: Subject to any disclaimer, the term of this patent is extended or adjusted under 35 U.S.C. 154(b) by 0 days.

(21) Appl. No.: 15/862,014

(22) Filed: Jan. 4, 2018

(65) Prior Publication Data

US 2019/0169870 A1 Jun. 6, 2019

(51) Int. Cl.
*E04H 4/14* (2006.01)
*E04H 4/00* (2006.01)

(52) U.S. Cl.
CPC ..... *E04H 4/144* (2013.01); *E04H 4/0093* (2013.01)

(58) Field of Classification Search
CPC ..... E04H 4/133; E04H 4/0093
USPC ..... 52/169.7
See application file for complete search history.

(56) References Cited

U.S. PATENT DOCUMENTS 3,497,877 A * 3/1970 Greenberg ..... E04H 4/0037 4/513
3,708,807 A * 1/1973 Chase ..... E04H 4/0037 4/494
3,793,653 A * 2/1974 Brooks ..... E04H 4/0037 4/513
3,823,690 A * 7/1974 Rynberk ..... E04H 4/00 119/228
3,908,205 A * 9/1975 Chase ..... E04H 4/0037 4/513
3,962,734 A * 6/1976 Chase ..... E04H 4/0037 4/513
4,306,394 A * 12/1981 Blakeway ..... E04H 4/142 4/506
D298,055 S * 10/1988 O'Brien ..... 4/573.1
5,400,555 A * 3/1995 Kantor ..... E04H 4/0043 256/24
5,729,937 A * 3/1998 Mantelli ..... E03F 3/046 404/4
5,790,990 A * 8/1998 Hall ..... E04H 4/144 4/488
2009/0151066 A1* 6/2009 Sullivan ..... E04H 4/0037 4/506
2013/0014321 A1* 1/2013 Sullivan ..... E04H 4/0018 4/506
2017/0167153 A1* 6/2017 Paull ..... E04H 4/1272

FOREIGN PATENT DOCUMENTS

JP 02112564 A * 4/1990

* cited by examiner

*Primary Examiner* — Jeanette E Chapman
(74) *Attorney, Agent, or Firm* — C. John Brannon; Brannon Sowers & Cracraft PC

(57) ABSTRACT

A fiberglass swimming pool system, including a fiberglass swimming poll body defining an interior volume for holding water and positioned in an excavation, a fiberglass flange operationally connected to the fiberglass swimming pool body, a fiberglass lip extending from the flange away from the fiberglass swimming pool body, an elongated fiberglass riser wall extending perpendicularly from the flange, a fiberglass ramp extending from the elongated fiberglass riser wall into the interior volume, and a deck extending over the lip and operationally connected to the fiberglass ramp at the riser wall. The fiberglass ramp has an angle of decline of between one and fifteen degrees.

14 Claims, 7 Drawing Sheets

BEACH ENTRY FIBERGLASS POOL BODY

TECHNICAL FIELD

The present novel technology relates generally to the field of fiberglass materials, and, more particularly, to a method and apparatus for providing a beach entry area for in-ground fiberglass pool bodies.

BACKGROUND

Preformed fiberglass swimming pools offer many advantages over vinyl liner and in-situ formed shotcrete or concrete walled swimming pools. Fiberglass pool bodies may be quickly and inexpensively formed and require considerably less effort to put into the ground. Recently, there has been increased interest in swimming pools having a preformed shallow entry area beginning flush with the outside ground at the pool edge and extending into the pool at a shallow angle, such that a swimmer may walk into the pool enjoying a slow and steady entry into the pool as the water gradually becomes deeper. Such an entry area is commonly known as a 'beach entry'. Beach entries are relatively easy to form in concrete pools, as the concrete may be poured and spread to yield a shallow angled beach entry floor extending from the outer edge or lip of the pool into the main pool body. However, such a beach entry area has been elusive in preformed pools, as the lip/flange has to perform other functions, such as engaging poured concrete forming an upper sidewalk around the pool that partially anchors the fiberglass pool in place, engaging and directing backfill around the exterior of the preformed pool body, providing structure to the pool body and/or providing a level surface for orienting the pool body in the excavation.

Thus, there remains a need for a method and apparatus that would allow easy installation of a preformed fiberglass swimming pool body with a preformed unitary, or aftermarket, accessory allowing beach entry. The present novel technology addresses this need.

SUMMARY

The present novel technology relates to a method and apparatus for providing shallow angle beach entry into a fiberglass swimming pool body. One object of the present novel technology is to provide an improved fiberglass swimming pool system. Related objects and advantages of the present novel technology will be apparent from the following description.

DETAILED DESCRIPTION OF THE PREFERRED EMBODIMENT

Figure 1:
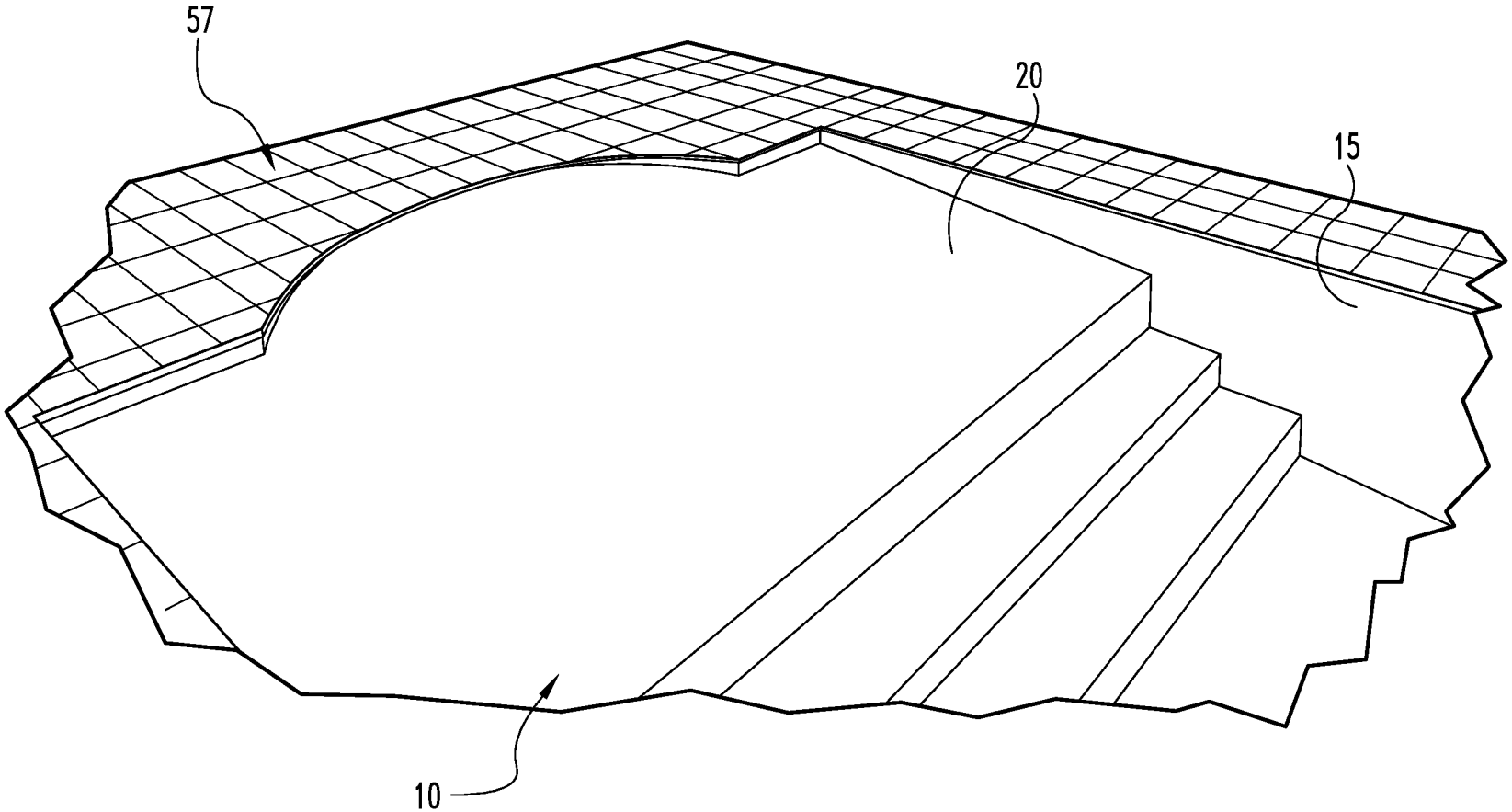
FIG. 1 is a partial side elevation view of a first embodiment fiberglass pool assembly of the present novel technology.
Figure 2:
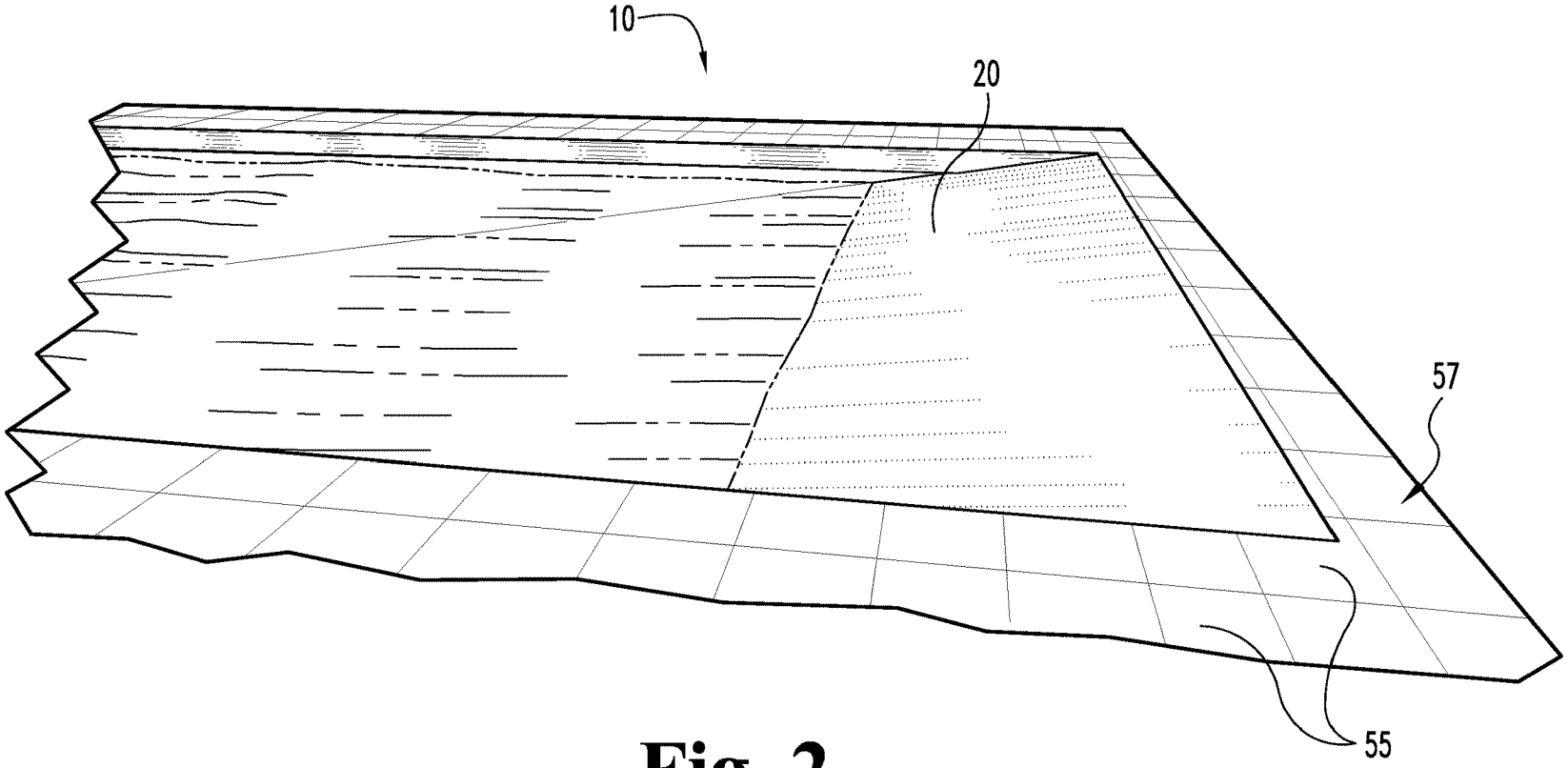
FIG. 2 is a partial side elevation view of a second embodiment fiberglass pool assembly of the present novel technology.
Figure 3:
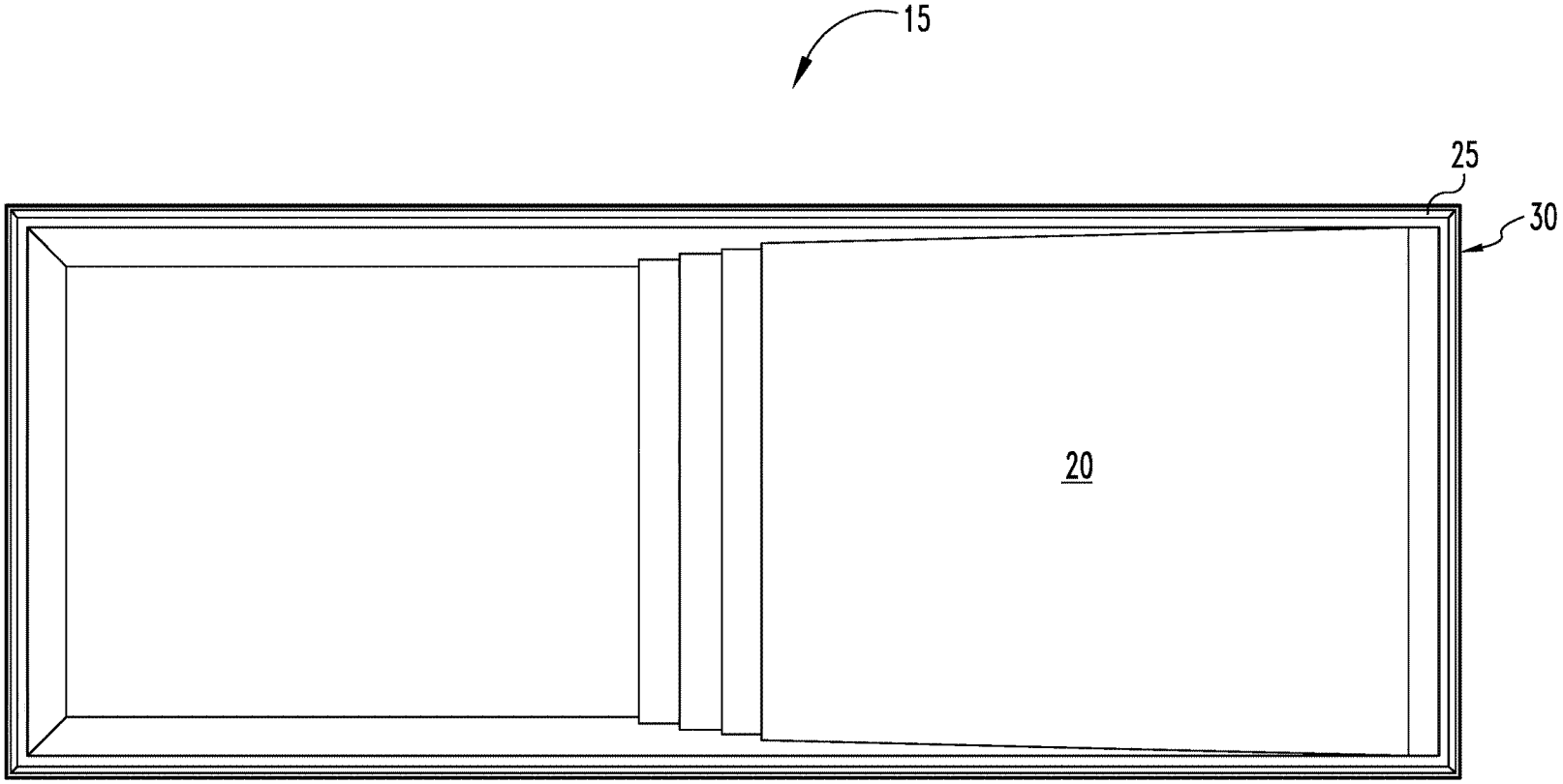
FIG. 3 is a top plan view of a third embodiment fiberglass pool assembly of the present novel technology.
Figure 4:
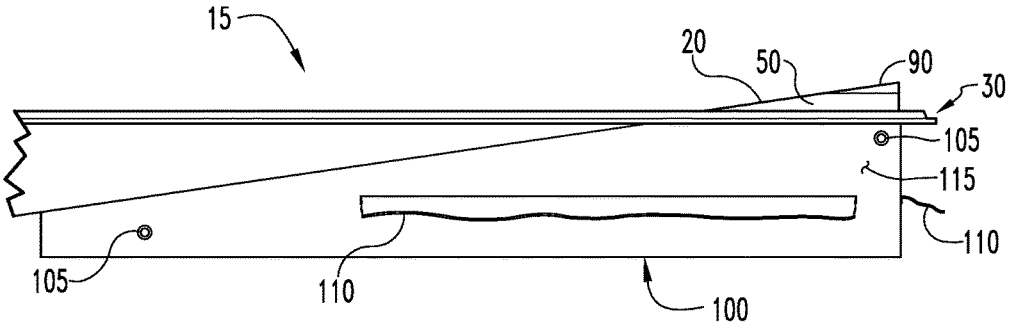
FIG. 4 is a partial side elevation of the pool assembly of FIG. 3.
Figure 5:
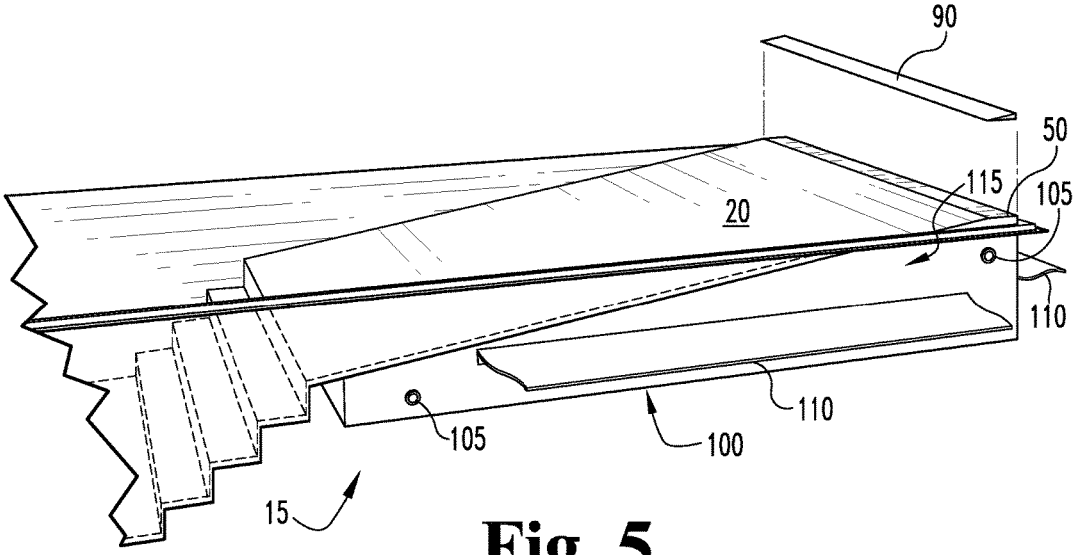
FIG. 5 is a partial top perspective view of the pool assembly of FIG. 3.
Figure 6:
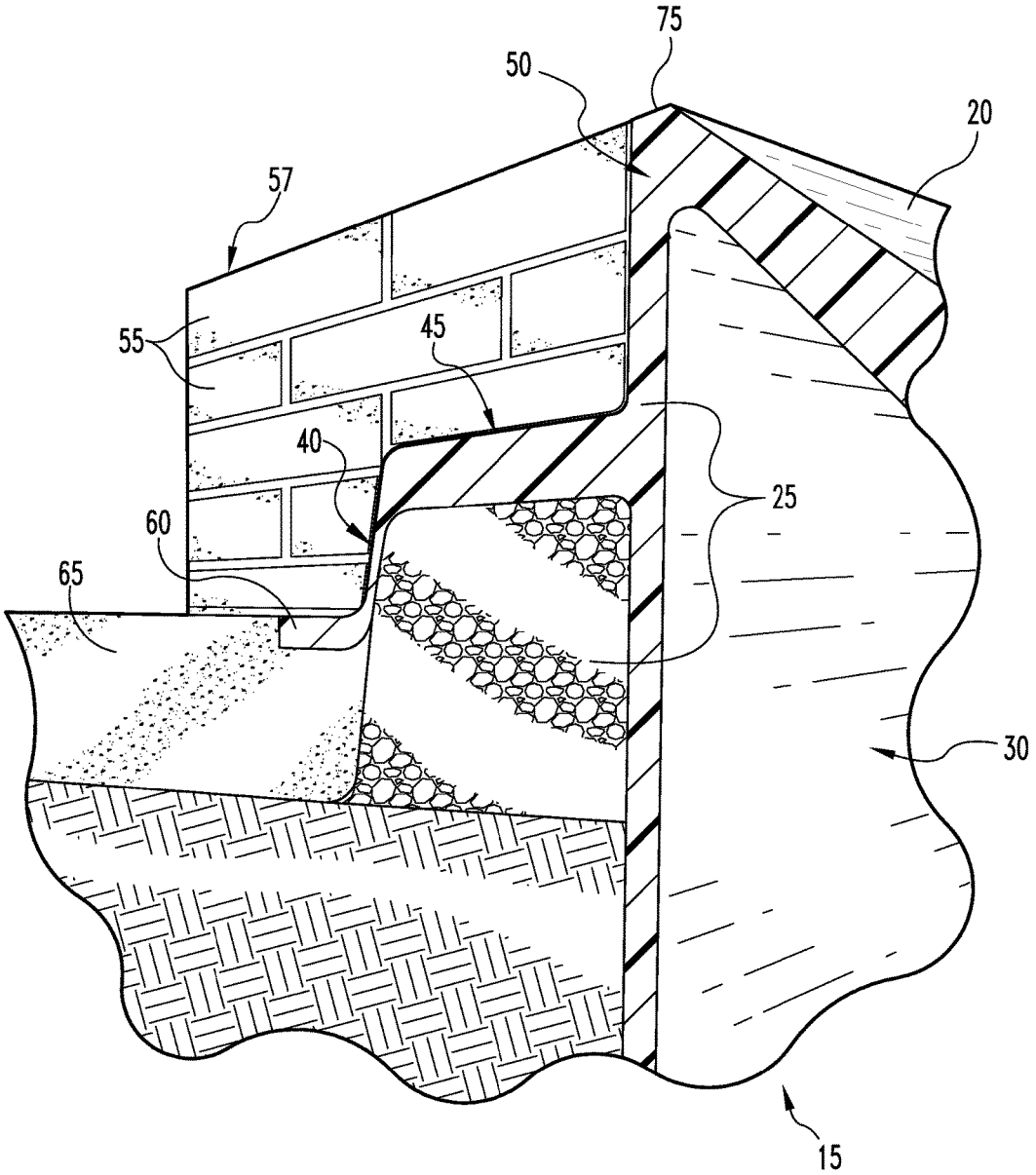
FIG. 6 is an enlarged partial perspective view of the flange and riser portions of FIG. 3.
Figure 7:
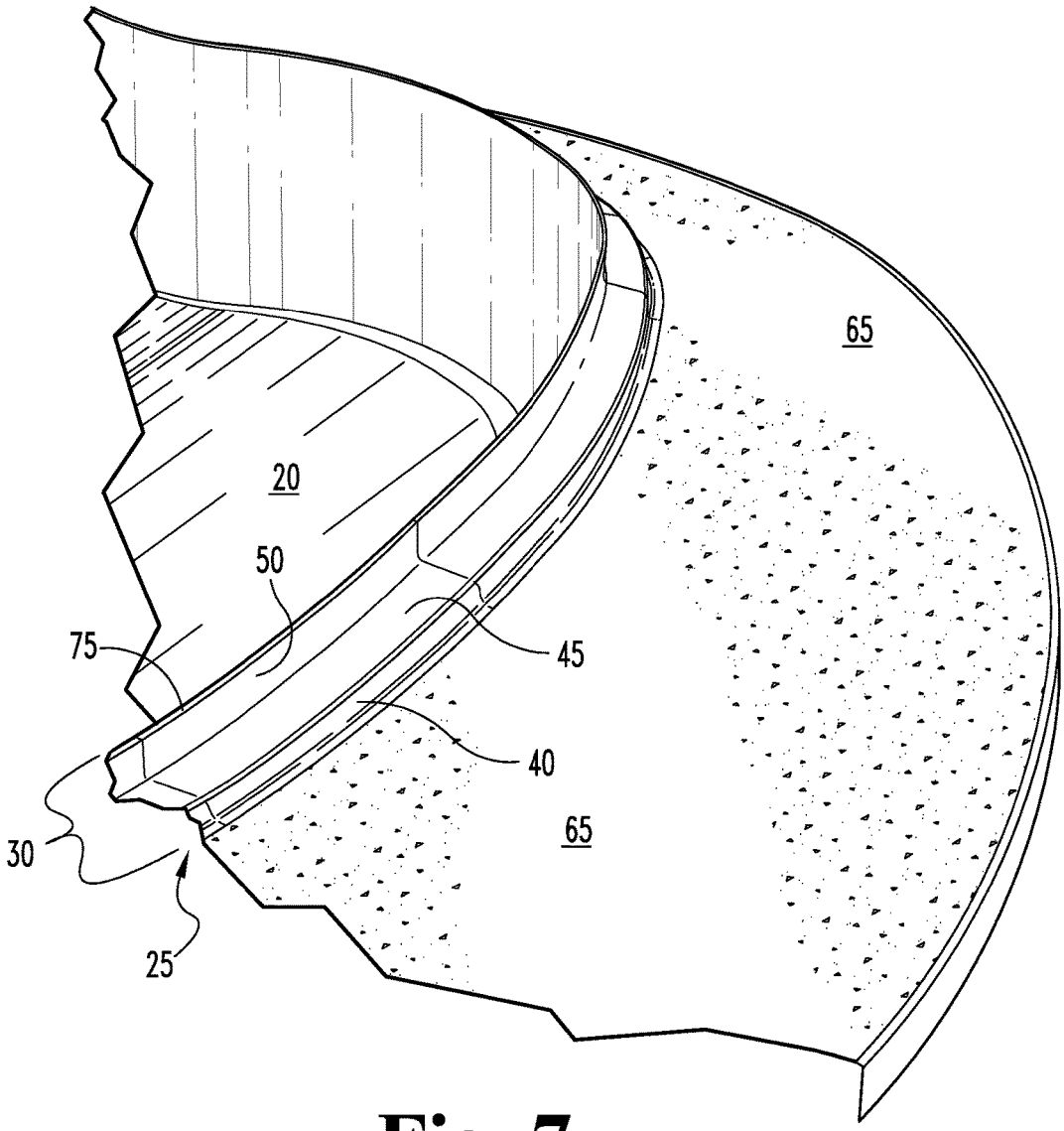
FIG. 7 is a partial perspective view of a bond beam formed around an emplaced pool body.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

The present novel technology relates to an assembly 10 for allowing gradual entry into a fiberglass bodied swimming pool 15, as illustrated in FIGS. 1-7. The assembly 10 includes a shallow ramp member 20 connected to and extending from an endless upper flange member 25. The endless upper flange member 25 is part of the flange assembly 30 defining the upper perimeter of the swimming pool body 15 as emplaced in the ground. Flange 25 typically has a generally rectangular cross-section with an inner wall 35 (relative the swimming pool body) and outer wall 40, and a top wall 45 extending therebetween. The inner and outer walls 35, 40 are typically parallel, and more typically extend generally vertically upwardly when the swimming pool body 15 is emplaced in the ground. Inner and outer walls are typically between 2 and 3 inches in length, and top wall is likewise typically between 2 and 3 inches in length.

Flange assembly includes a (typically elongated) flange riser 50, which extends generally parallel with the inner wall 35 and perpendicular to the top wall 45, typically extending between 1 and 5 inches, more typically between 2 and 4 inches, beyond top wall 45. The flange riser 50 is typically not endless. Flange riser 50 is typically formed flush with inner wall 35, and may be formed as an extension of inner wall 35. Flange riser 50 typically extends beyond the top wall 45 of the flange 25 an equal distance to the thickness of bricks, concrete, pavers, wood, combinations thereof, or like finishing material 55 to be emplaced around the perimeter of the swimming pool body 15 once positioned in the ground to define a deck 57. The finishing material 55 is typically positioned over the lip 60 extending perpendicularly from outer wall 45 (typically several inches), so as to assist in anchoring the pool body in place and providing a counterforce opposing groundwater buoyancy forces that may act to push the pool body 15 out of the ground when water levels are low. The pool body 15 is first anchored in place by a concrete pour over the lip 60 to define an anchoring bond beam 65 that surrounds and locks the pool body 15 in place. The additional finishing material 55 is positioned over the bond beam 65 and defines a deck, walkway, or the like 57 leading to the edge of the pool body 15. Flange assembly 30, riser 50, and shallow ramp 20 are typically formed of fiberglass, and are more typically integrally formed with the pool body 15.

Beach entry ramp 20 extends from the top edge 75 of the riser 50 into the pool at a shallow angle of decline into the pool, typically between five and ten degrees, more typically about seven degrees, although any convenient angel may be elected, for a predetermined distance, typically between four and twelve feet, more typically between six and ten feet, still more typically about eight feet, and then drops off at a greater angle, often about ninety degrees, defining deeper water and mimicking a shelf drop-off.

Figure 8:
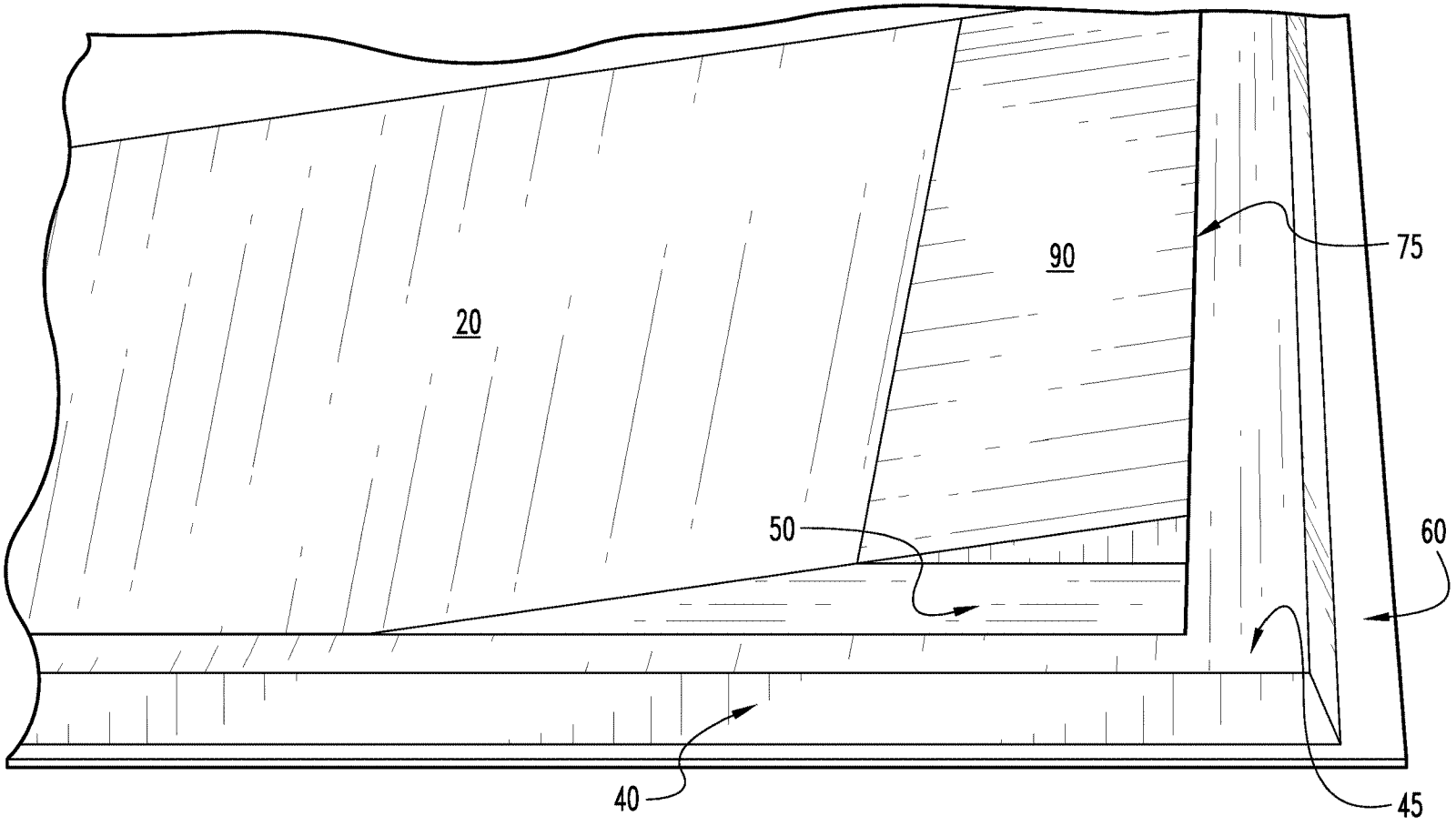
FIG. 8 is a partial perspective view of a fourth embodiment pool body having a flange riser.

In some embodiments, a top insert member 90 may be positioned over the beach entry ramp 70, covering the riser 50 and extending therefrom over the shallow ramp portion 20 to adjust the effective coping height of the riser 50 to accommodate variations in deck 57 thickness. (See FIG. 8). Thus, a riser 50 designed to accommodate a four-inch concrete pour may be modified to instead accommodate two-inch pavers or a shallower concrete pour. The insert member 90 is typically adhered to the ramp 20, such as with a fiberglass bond or adhesive material, and finished to blend virtually seamlessly with the underlying pool body 15. In some embodiments, the insert 90 is placed into the mold before the pool body 15 is formed, resulting in a pool body 15 with the riser 50 and ramp 20 adjustments made prior to pool body formation.

In some embodiments, a support structure/backfill eliminator body 100 is positioned beneath the shallow ramp 20 to increase stability, increase ease of installation, and decrease the amount of backfill required to install the pool body 15. The support structure 100 also reduces or eliminates flexure of the shallow ramp when in use.

The support structure 100 is typically a generally hollow housing or body with one or more apertures 105 formed therethrough and is typically made of a lightweight structural material, such as fiberglass, aluminum, or the like, although the support structure 100 may simply be one or more structural members or pillars. Typically, at least one, and more typically a plurality, flexible, tough sheet segment 110 is securely bonded to one or more exterior sidewalls 115 of the support structure 100 for extension therefrom. The support structure 100 is more typically an open-topped enclosure, with the shallow ramp portion, when connected thereto, defining an enclosing top.

Typically, an anchor member 110, such as one or more flexible sheets of geotextile, fiberglass, or like material and/or a rigid anchoring flange formed from fiberglass, aluminum, or like material, or the like, is operationally connected to the support structure 100 to extend therefrom for burial with backfill to assist in anchoring and stabilizing the support structure 100 and the pool body 15. Likewise, anchor members 110 are typically operationally connected to the pool body 15 for extension therefrom and burial with backfill to likewise anchor the pool body 15 in place.

In operation, the pool body 15 is emplaced in an excavation, with a support structure 100 optionally positioned beneath the shallow ramp 20, and the remaining excavation is backfilled with gravel, sand, dirt, and/or the like. In some embodiments, anchor members 110 operationally connected to the pool body 15 and/or the support structure 110 are extended therefrom and buried in the backfill. A bond beam 65 is poured to operationally connect to the pool body 15 and help hold the body 15 in place, and finishing materials are positioned to further assist in anchoring the pool body 15 as well as to define a generally horizontal deck 57 operationally connected to the pool body 15. The deck connects to the top edge 75 of the riser 50 and thus to the shallow ramp 20, to allow a smooth walking transition from the deck 57 into the pool 15 and down the ramp 20 to gradually enter the water.

The pool body 15 may be of any convenient shape, including rectangular, generally rectangular, kidney shaped, round, oval, or the like. The ramp 20 is typically textured to be slip resistant, and may accommodate waders, tanners, as well as chairs and loungers. In some embodiments, the ramp 20 completely replaces stairs for pool entry.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

We claim:

1. A fiberglass swimming pool assembly, comprising:

a fiberglass swimming pool body defining an interior volume;

an endless raised flange assembly comprising an inner wall, an outer wall, a top wall, and an elongated riser, said endless raised flange assembly surrounding and operationally connected to the fiberglass swimming pool body and defining a perimeter, wherein the endless raised flange assembly further comprises generally parallel inner and outer walls and a top wall extending therebetween;

a lip extending from the endless raised flange assembly and disposed opposite the swimming pool body;

said elongated riser extending away from the interior volume past the top wall and disposed partially along the perimeter from the inner wall and disposed generally perpendicular to the top wall; and a shallow fiberglass ramp extending from the elongated riser into the interior volume.

2. The assembly of claim 1 wherein the shallow fiberglass ramp is oriented relative horizontal at an angle of decline of between one and ten degrees.

3. The assembly of claim 2 wherein the angle of decline is seven degrees.

4. The assembly of claim 1 and further comprising a support structure operationally connected to and disposed below the fiberglass ramp.

5. The assembly of claim 1 and further comprising an anchor member operationally connected to, and extendable from, the support structure.

6. The assembly of claim 5 wherein the anchor member is at least one geotextile sheet.

7. The assembly of claim 1 and further comprising a horizontal deck operationally connected to, and extending from, the fiberglass ramp.

8. The assembly of claim 7 wherein the swimming pool body is positioned in an excavation and wherein the horizontal deck is selected from the group comprising wood, pavers, concrete, brick, and combinations thereof.

9. The assembly of claim 1 wherein the fiberglass ramp is formed unitarily with the fiberglass swimming pool body.

10. A fiberglass swimming pool system, comprising:

a fiberglass swimming pool body defining an interior volume for holding water and positioned in an excavation;

a fiberglass flange operationally connected to the fiberglass swimming pool body;

a fiberglass lip extending from the fiberglass flange away from the fiberglass swimming pool body;

an elongated fiberglass riser wall extending perpendicularly from the fiberglass flange and away from the interior volume beyond the fiberglass flange; and a fiberglass ramp extending from the elongated fiberglass riser wall into the interior volume; and a deck extending over the lip and operationally connected to the fiberglass ramp at the riser wall;

wherein the fiberglass ramp has an angle of decline between one and fifteen degrees.

11. The system of claim 10 wherein the fiberglass swimming pool body, the fiberglass flange, the fiberglass lip, the fiberglass riser wall, and the fiberglass ramp are all one unitary piece.

12. The system of claim 10 wherein the deck is selected from the group comprising brick, concrete, wood, pavers, and combinations thereof.

13. The system of claim 10 and further comprising a support structure operationally connected to the fiberglass ramp; wherein the support structure is positioned in the excavation.

14. The system of claim 10 wherein the fiberglass ramp has an angle of decline of about seven degrees.

* * * * *